US005967070A

United States Patent [19]

Gries

[11] Patent Number: 5,967,070

[45] Date of Patent: Oct. 19, 1999

[54] PROCESS FOR SHORTENING A FABRIC-SIDE HOOK THREAD END IN SEWING MACHINES WITH THREAD CUTTING DEVICE

[75] Inventor: Franz Gries, Trippstadt, Germany

[73] Assignee: G.M. PFAFF Aktiengesellschaft, Kaiserslautern, Germany

[21] Appl. No.: 09/151,185

[22] Filed: Sep. 10, 1998

[30] Foreign Application Priority Data

Oct. 22, 1997 [DE] Germany ..... 197 46 653

[51] Int. Cl.[6] ..... D05B 65/02

[52] U.S. Cl. ..... 112/475.17; 112/275; 112/292; 112/300

[58] Field of Search ..... 112/475.17, 475.01, 112/288, 291, 292, 293, 295, 296, 298, 300, 275

[56] References Cited

U.S. PATENT DOCUMENTS 4,491,080 1/1985 Hager .
4,528,923 7/1985 Hager .
5,154,130 10/1992 Gribetz et al. ..... 112/292
5,375,546 12/1994 Butzen et al. ..... 112/292

FOREIGN PATENT DOCUMENTS 197 22 395 of 0000 Germany .
16 85 087 B2 6/1971 Germany .

*Primary Examiner*—Peter Nerbun
*Attorney, Agent, or Firm*—McGlew and Tuttle, P.C.

[57] ABSTRACT

The fabric-side hook thread end (GN), which was previously longer than the fabric-side needle thread end (NN) by the amount corresponding to a stitch length, is to be shortened in sewing machines with a thread-cutting device. This object is accomplished by the feed device of the sewing machine, of which there is at least one, performing a partial feed step in the reverse feed direction during the performance of the thread-cutting process.

1 Claim, 3 Drawing Sheets

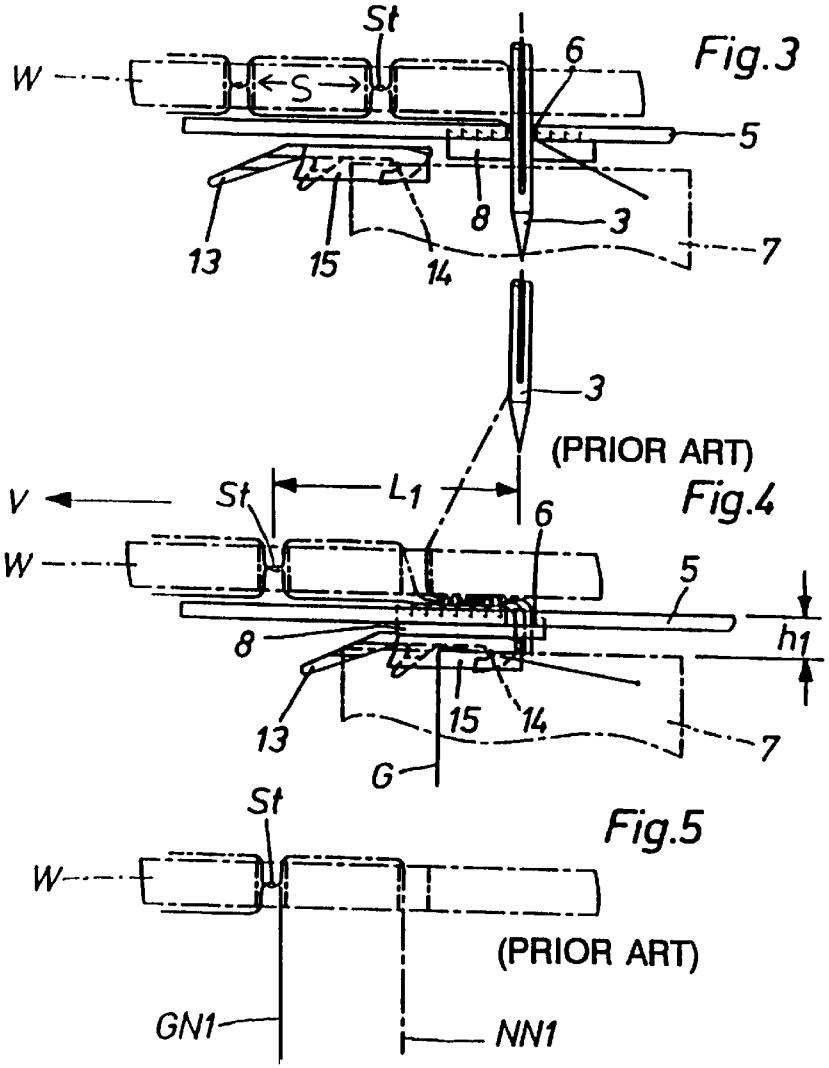
Fig.3
Fig.4
(PRIOR ART)
Fig.5
(PRIOR ART)
W
V
St
S
3
5
6
7
8
13
14
15
L1
h1
G
GN1
NN1
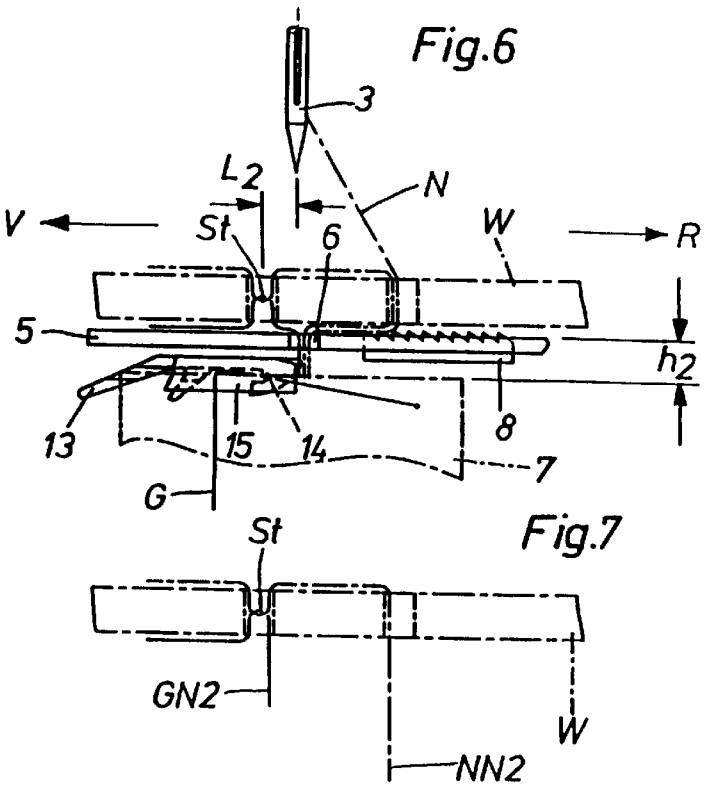
Fig.6
Fig.7
W
V
R
N
3
5
6
7
8
13
14
15
L2
h2
St
G
GN2
NN2

PROCESS FOR SHORTENING A FABRIC-SIDE HOOK THREAD END IN SEWING MACHINES WITH THREAD CUTTING DEVICE

FIELD OF THE INVENTION

The present invention pertains to a process for shortening a fabric-side hook thread with a thread-carrying needle, with a hook cooperating with the thread-carrying needle, with a take-up lever, with at least one feed element, and with a thread-cutting device with a catch thread device.

BACKGROUND OF THE INVENTION

The thread-cutting process usually takes place as follows in a sewing machine equipped with a thread-cutting device: The sewing machine is stopped at the end of the seam with the needle in the lower position. The sewing machine is then driven briefly once again, in the course of which the arm shaft performs half a revolution and the hook a full revolution, and the take-up lever assumes the top dead center of its path of movement. In the course of this half revolution of the arm shaft, the catch thread device of the thread-cutting device performs a catching or separating movement, by which the threads to be cut are caught, during the time at which the hook has widened the needle thread loop. The cutting of the threads proper takes place only at the end of the half revolution of the arm shaft, when the take-up lever is stopped at the top dead center of its path of movement.

Since no sewing stitch formed by the looping of the hook and needle threads is formed by the thread cutting, the fabric-side needle thread end therefore emerges from the fabric after the thread cutting at the site of the last insertion of the needle, while the hook thread end hangs down from the fabric at the site of the last complete stitch. Since these two points are spaced apart from one another by one stitch length, i.e., the length of one feed step, the hook thread end is consequently longer than the needle thread end by the amount of the stitch length.

This situation and the result linked with it, which may have an adverse effect under certain circumstances, are shown in FIGS. 4 and 5 of the drawing in the case of a sewing machine with lower feed and in FIGS. 9 and 10 in the case of a sewing machine with combined lower feed and needle feed.

To avoid this situation, it is proposed in a thread-cutting device known from DE 16 85 087 B2 that the last stitch formation process, during which the thread cutting is to take place, be performed at the point at which the last complete sewing stitch was formed. Even though both the hook thread end and the needle thread end will thus hang down from the fabric at the same point and thus have the same length, this is achieved by accepting the drawback that a complete stitch must first be formed at this point after stopping the sewing machine and switching over the stitch length mechanism to zero stitch length before the half revolution of the arm shaft can take place as in the state of the art for performing the thread-cutting process. An additional stitch formation process must therefore be carried out in the prior-art thread-cutting device between the stopping of the machine and the thread cutting compared with the above-described state of the art. However, such an additional stitch formation process may lead overall to an undesired, considerable loss of time in the case of the sewing of a plurality of short seams.

SUMMARY AND OBJECTS OF THE INVENTION

The primary object of the present invention is therefore to provide a process for shortening the fabric-side hook thread end, during the performance of which no loss of time occurs.

According to the invention, a process is provided for shortening the fabric-side hook thread end in sewing machines with a thread-carrying needle, with a hook cooperating with the thread-carrying needle, with a take-up lever, with at least one feed element, and with a thread-cutting device with a catch thread device. The process includes stopping the sewing machine with the needle in a lower position and subsequently briefly driving the sewing machine once again until the take-up lever reaches its top dead center. The catch thread device is moved during this phase of movement of the sewing machine into its separating or catching position and the direction of feed of the feed element, of which there is at least one, is switched over into the reverse direction. The threads are cut at a point in time at which the take-up lever is located in its top dead center and the direction of feed of the feed element, of which there is at least one, has moved opposite the normal direction of feed by at least half of one feed step.

Based on the discovery that in a sewing machine with lower feed, the fabric feed dog will have covered more than half, namely, about ¾ of its feed motion, in both forward and reverse feed, by the time at which the thread layer has reached its top dead center and at which the threads are cut, it is consequently achieved, due to the measure of reversing the feed motion into the reverse feed direction during a thread-cutting process, that the sewing stitch last formed is not removed farther from the stitch hole of the needle plate by about ¾ stitch length as before, but it is moved closer to the stitch hole by about ¾ stitch length. The consequence of this is that the fabric-side hook thread end is correspondingly shorter by twice the amount of the partial feed path, i.e., by about 1½ stitch length, than in the prior-art process, while the fabric-side needle thread end essentially retains its already short length compared with the prior-art process.

A similar result is obtained in the case of sewing machines with combined lower feed and needle feed, in which the stitch hole is not contained in the needle plate but in the feed dog, which forms, together with the needle, the feed elements of the sewing machine which cooperate with one another. After the needle has emerged from the fabric and the feed dog has moved away from the fabric in the downward direction, the needle and the feed dog perform a horizontal movement directed against the normal feed motion by the amount of the stitch length before they again come into contact with the fabric. The stitch hole of the feed dog now moves away from the sewing stitch formed last by the same amount by which the sewing stitch moves away in sewing machines with lower feed from the stitch hole, which is stationary in such sewing machines. When the feed motion is switched over into the reverse feed direction during the performance of a thread-cutting process, the stitch hole moves toward the last sewing stitch to the extent that the fabric-side hook thread end will be shorter by far more than one stitch length than in the prior-art process in this case as well.

The process of shortening the previously longer hook thread end is preferably suitable for use in a sewing machine with a thread-cutting device which generates, like the thread-cutting device according to the later-published German Patent Application No. 197 22 395, especially short fabric-side thread ends. Optimally short thread ends are thus generated, which are required to avoid the subsequent cleaning of the thread, i.e., the subsequent cutting of projecting thread ends during the manufacture of cushions and during the manufacture of vehicle seats.

The present invention will be explained on the basis of two exemplary embodiments implemented in different sewing machines.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a schematic partially sectional side view of the position of the feed dog and catch thread device with the needle in the bottom dead center before the beginning of a thread-cutting process in a sewing machine with lower feed;

FIG. 4 is a schematic partially sectional side view of the position of the needle, feed dog and catch thread device after cutting the threads according to the prior-art process known from the state of the art;

FIG. 5 is a schematic view showing the cutting result for the prior-art process;

FIG. 6 is a schematic partially sectional side view of the position of the needle, feed dog and catch thread device after cutting the threads in the process according to the present invention;

FIG. 7 is a schematic view showing the cutting result for the process according to the present invention;

DETAILED DESCRIPTION OF THE PREFERRED EMBODIMENT

Figure 1:
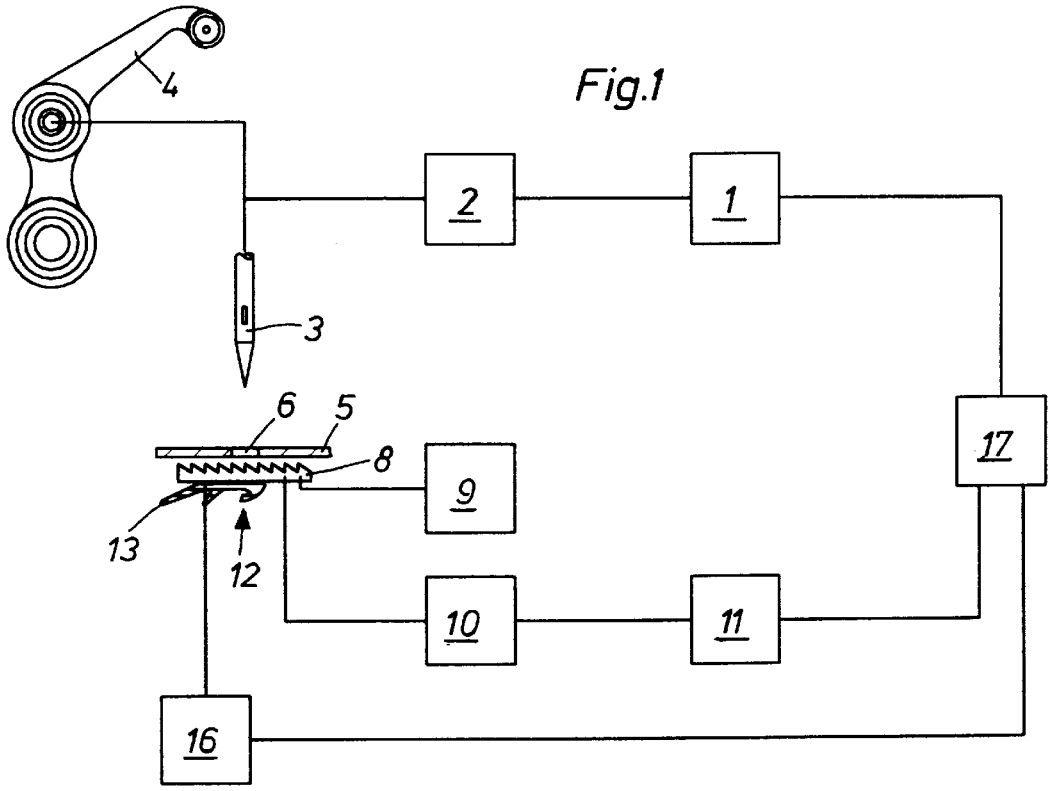
FIG. 1 is a schematic representation of a sewing machine with lower feed.

The sewing machine with lower feed, which is schematically shown in FIG. 1, is of the usual design and correspondingly has a drive mechanism 2 connected to a drive motor 1 for the needle bar, not shown specifically, with the needle 3 and with the take-up lever 4. A horizontally rotating hook 7 shown schematically in FIGS. 3, 4 and 6 is arranged under a needle plate 5 with a stitch hole 6. The only feed element of the sewing machine is formed by a feed dog 8, whose rectangular movement is generated by a lifting drive 9 and a pushing drive 10. A stitch length mechanism 11 is associated with the pushing drive 10. The design embodiment of these mechanisms corresponds to those known from DE 31 50 141 C1, which corresponds to U.S. Pat. No. 4,491,080 (which is hereby incorporated by reference).

The sewing machine is equipped with a thread-cutting device 12, which has a catch thread device 13 with a cutting edge 14 (FIGS. 3, 4 and 6), and a knife 15. The drive mechanism of the thread-cutting device 12 is designated by 16. The design and the mode of action of the thread-cutting device 12 correspond to the thread-cutting device according to the above-mentioned German Patent Application No. 197 22 395. The knife 15 can be correspondingly moved from a resting position into a cutting position located adjacent to the stitch hole 6, which is a prerequisite for obtaining short fabric-side thread ends.

In conjunction with a pedal, not shown, a control device designated by 17 controls the drive motor 1, the course of the thread-cutting process over time and the time of the switchover of the stitch length mechanism 11.

FIG. 3 shows the initial situation before the beginning of a thread-cutting process, in which the sewing machine was stopped at the end of the seam with the needle 3 in the lower position. The catch thread device 13 and the knife 15 are in the resting position located away from the stitch hole 6 at this point in time.

As the thread-cutting process is initiated, the sewing machine is briefly driven once again. The hook 7 now performs a full revolution, the take-up lever 4 reaches the top dead center of its path of movement, and the feed dog 8 performs a partial feed step of about ¾ of the stitch length.

The partial feed step takes place in the current feed direction V in the prior-art process, so that the sewing stitch St last formed is spaced from the stitch hole 6 by the amount $L_1=s+\frac{3}{4}s$, wherein s is the stitch length. At the time at which the hook 7 has widened the needle thread loop, the catch thread device 13 performs a catching or separating movement, by which the threads to be cut are caught. The knife 15 is moved at the same time from the resting position into the cutting position. FIG. 4 shows the situation immediately after the cutting through of the threads. The cutting points of the fabric-side ends NN1 and GN1 of the needle thread N and hook thread G, respectively, are located at a distance $h_1$ from the top side of the needle plate 5. Thus, a length of $L_{GN1}=s+\frac{3}{4}s+h_1$ is obtained for the fabric-side hook thread end GN1 in the prior-art process. The fabric-side needle thread end NN1 has a length of $L_{NN1}=\frac{3}{4}s+h_1$. Thus, the fabric-side hook thread end GN1 is thus longer in the prior-art process than the fabric-side needle thread end NN1 by the amount of the stitch length s (FIG. 5).

In the new process, the stitch length mechanism 11 is switched over to reverse feed essentially simultaneously with the initiation of the movement of the catch thread device 13 at the beginning of the thread-cutting process. The consequence of this is that, according to FIG. 6, the partial feed step of the feed dog 8 now takes place in the reverse direction R, and the sewing stitch St formed last is correspondingly moved closer to the stitch hole 6 by the amount $L_2=s-\frac{3}{4}s=\frac{1}{4}s$. Thus, a length of $L_{GN2}=\frac{1}{4}s+h_2$, in which $h_2$ is equal to $h_1$, is obtained for the fabric-side hook thread end GN2 in the new process. The fabric-side needle thread end NN2 now has a length of $L_{NN2}=\frac{3}{4}s+h_2$, wherein $L_{NN2}$ is equal to $L_{NN1}$. Thus, the fabric-side hook thread end GN2 is shorter in the new process by half the stitch length than the fabric-side needle thread end NN2 (FIG. 7).

Figure 2:
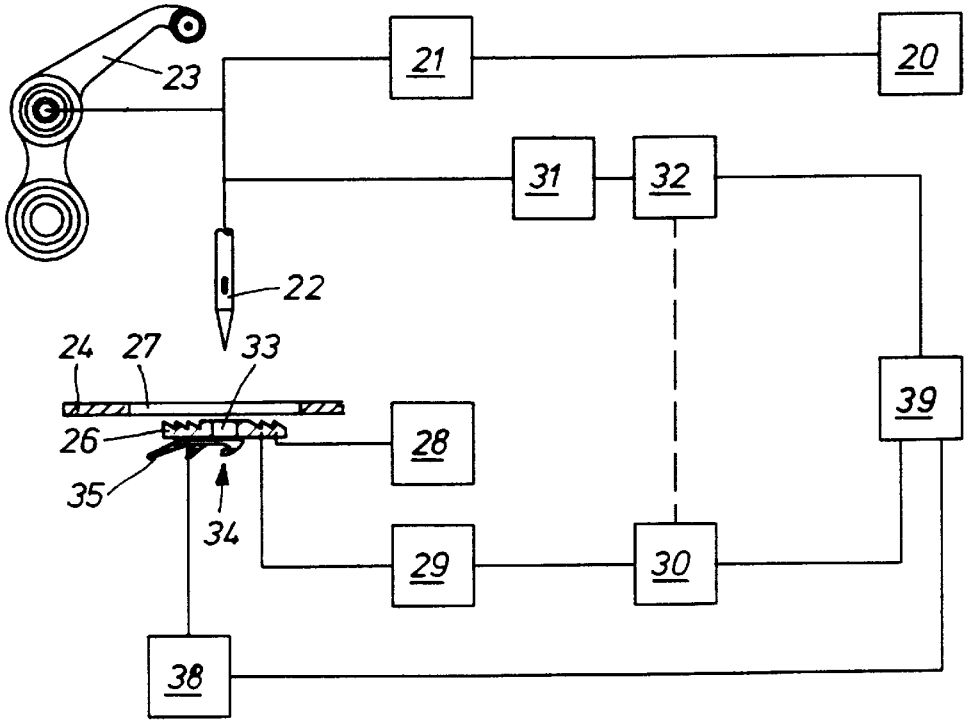
FIG. 2 is a schematic representation of a sewing machine with combined lower feed and needle feed.
Figure 11:
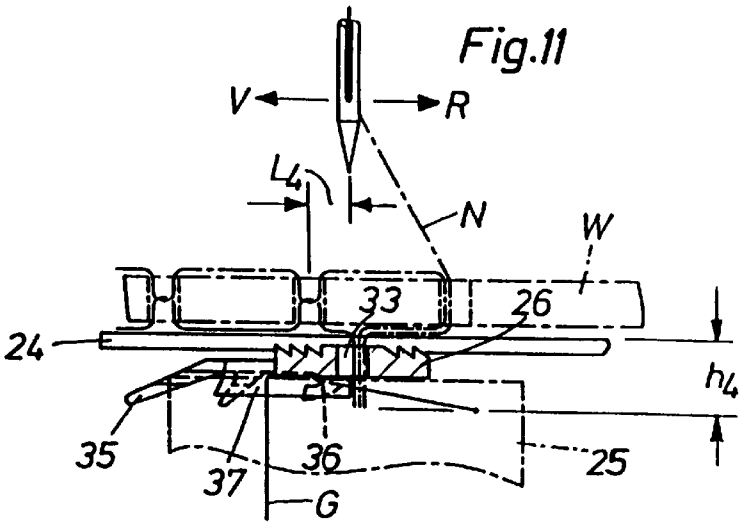
FIG. 11 is a schematic partially sectional side view of the position of the needle, feed dog and catch thread device after cutting the threads in the process according to the present invention.
Figure 12:
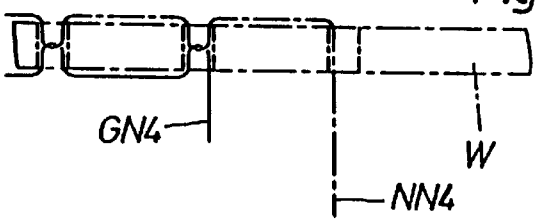
FIG. 12 is a schematic view showing the cutting result in the process according to the present invention.

The sewing machine with combined lower feed and needle feed, which is schematically shown in FIG. 2, is likewise of the usual design and correspondingly has a drive mechanism 21 connected to a drive motor 20 for the needle bar, not shown, with the needle 22 and with the take-up lever 23. A horizontally rotating hook 25, shown schematically in FIGS. 8, 9 and 11, is arranged under a needle plate 24.

This sewing machine has two feed elements, namely, a feed dog 26, which is arranged under the needle plate 24 and comes into contact with the fabric W through a corresponding opening 27 in the needle plate 24, on the one hand, and the needle 22, which synchronously cooperates with the feed dog 26, on the other hand. The rectangular movement of the feed dog 26 is generated by a lifting drive 28 and a pushing drive 29. A stitch length mechanism 30 is associated with the pushing drive 29. The feed motion to be performed by the needle 22 is generated by a pushing drive 31 acting on the pendularly mounted needle bar. A stitch length mechanism 32 is associated with the pushing drive 31. The two stitch length mechanisms 30 and 32 are mechanically connected to one another, so that the same stitch length is always set in both and the needle 22 always moves synchronously in the horizontal direction with the stitch hole 33 contained in the feed dog 26. The design embodiment of these mechanisms corresponds to that known from DE 33 24 715 C2, which corresponds to U.S. Pat. No. 4,528,923 (which is hereby incorporated by reference).

As in the first exemplary embodiment, the sewing machine is equipped with a thread-cutting device 34, which has a catch thread device 35 with a cutting edge 36 (FIGS. 8, 9 and 11), and a knife 37. The drive mechanism of the thread-cutting device 34 is designated by 38. The design and the mode of operation of the thread-cutting device 34 correspond to those known from the above-mentioned German Patent Application No. 197 22 395. In conjunction with a pedal, not shown, the control device designated by 39 controls the course of a thread-cutting process over time and the time of the switchover of the stitch length mechanisms 30 and 32.

Figure 8:
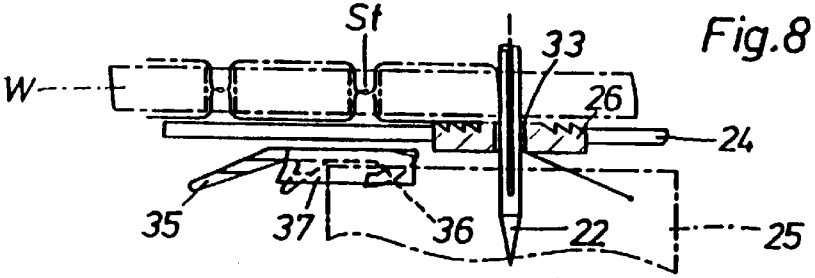
FIG. 8 is a schematic partially sectional side view of the position of the feed dog and catch thread device with the needle in the bottom dead center before the beginning of a thread-cutting process in a sewing machine with combined lower feed and needle feed.
Figure 9:
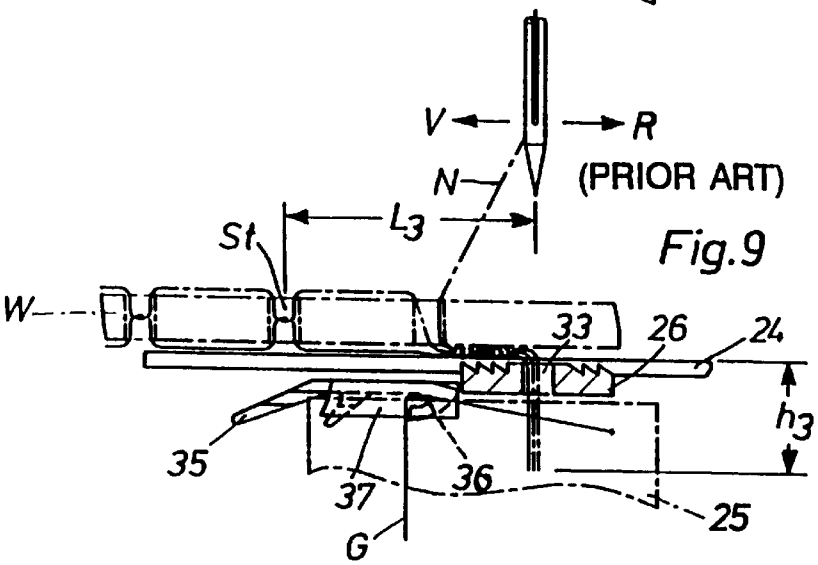
(PRIOR ART) Fig.9
FIG. 9 is a schematic partially sectional side view of the position of the needle, feed dog and catch thread device after cutting the threads in the prior-art process according to the state of the art.

FIG. 8 shows the initial situation before the beginning of a thread-cutting process, in which the sewing machine was stopped at the end of a seam with the needle 22 in the lower position. The catch thread device 35 and the knife 37 are in their resting position at this point in time.

As the thread-cutting process is initiated, the sewing machine is briefly driven once again, while the hook 25 performs a full revolution and the take-up lever 23 reaches the top dead center of its path of movement. In the prior-art process, the feed dog 26 and the needle 22 still continue to push the fabric W in the direction of feed V by a partial amount (FIG. 9) until the needle 22 exits from the fabric W and the feed dog 26 moves away from the fabric W in the downward direction at the same time.

The feed dog 26 and the needle 22 then perform a horizontal return movement in the reverse direction, which amounts to about ¾ the set stitch length s. The stitch hole 33 of the feed dog 26 now moves away from the last sewing stitch St by the amount $L_3$=s+¾ s, pulling a corresponding amount of hook thread and needle thread after it. At the time at which the hook 25 has widened the needle thread loop, the catch thread device 35 performs a catching or separating movement, by which the threads to be cut are caught. The knife 37 is moved at the same time from the resting position into the cutting position.

Figure 10:
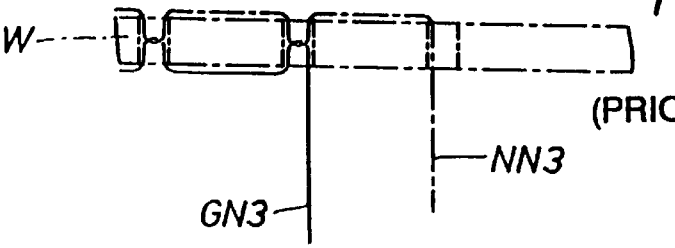
(PRIOR ART) Fig.10
FIG. 10 is a schematic view showing the cutting result in the prior-art process.

FIG. 9 shows the situation immediately after the cutting of the threads. The cutting points of the fabric-side ends NN3 and GN3 of the needle thread N and hook thread G, respectively, are now located at a distance $h_3$ from the top side of the needle plate 24. A length of $L_{GN3}$=s+¾ s+$h_3$ is thus obtained for the fabric-side hook thread end GN3 in the prior-art process. The fabric-side needle thread end NN2 has a length of $L_{NN3}$=¾ s+$h_3$. Thus, the hook thread end GN3 is also longer by the amount of the stitch length s than the fabric-side needle thread end NN3 in the prior-art process in the case of the sewing machine with combined needle feed and lower feed (FIG. 10).

With the needle 22 still inserted into the fabric W and with the feed dog 26 still in contact with the fabric W, the stitch length mechanisms 30, 32 are switched over to reverse feed in the new process in the course of the thread-cutting process by the end of a feed step that was performed in the forward direction V (FIG. 11). The consequence of this is that the needle 22 and the feed dog 26 are displaced jerkily in the reverse direction R by the amount of the stitch length s, and they pull the fabric W with them. As soon as the needle 22 has emerged from the fabric W and the feed dog 26 has moved away from the fabric W in the downward direction, the two feed elements 22, 26 perform the obligatory return movement, which now takes place, however, in the direction of feed V. This return movement also takes place in this case over a section of about ¾ of the stitch length s set. As is apparent from FIG. 11, the stitch hole 33 of the feed dog 26 approaches the sewing stitch St formed last to a distance of $L_4$=¼ s. Thus, a length of $L_{GN4}$=¼ s+$h_4$ is obtained for the fabric-side hook thread end GN4 in the case of the new process. The fabric-side needle thread end NN4 has the length $L_{NN4}$=¾ s+$h_4$.

Since the cutting point defined by the knife 37 located in the cutting position has a greater horizontal distance from the stitch hole 33 in the prior-art process according to FIG. 9 than in the new process according to FIG. 11, the amount $h_4$ is smaller than the amount $h_3$. The fabric-side needle thread end NN4 is correspondingly shorter than the needle thread end NN3 obtained in the prior-art process. The fabric-side hook thread end GN4 is likewise shorter than the needle thread end NN4 by half the stitch length.

While specific embodiments of the invention have been shown and described in detail to illustrate the application of the principles of the invention, it will be understood that the invention may be embodied otherwise without departing from such principles.

What is claimed is:

1. A process for shortening a fabric-side hook thread end in sewing machines with a thread-carrying needle, with a hook cooperating with the thread-carrying needle, with a take-up lever, with at least one feed element, and with a thread-cutting device with a catch-thread device, the process comprising the steps of:

operating the sewing machine and stopping the sewing machine with the needle in the lower position;

subsequent to said step of stopping the sewing machine, briefly driving the sewing machine until the take-up lever reaches a top dead center position;

moving the catch thread device in the same phase of movement of the sewing machine into a separating or catching position, and switching over the direction of feed of said feed element, of which there is at least one, into a reverse direction; and cutting the thread at a point in time at which the take-up lever is located in the top dead center position and the direction of feed of the feed element has moved opposite the normal direction of feed by at least half of one feed step.

* * * * *